US006174843B1

(12) United States Patent
Peyton et al.

(10) Patent No.: US 6,174,843 B1
(45) Date of Patent: Jan. 16, 2001

(54) COMPOSITION AND METHOD FOR LUBRICANT WAX DISPERSANT AND POUR POINT IMPROVER

(75) Inventors: Kim B. Peyton, Richmond; Sophia L. Wang, Houston, both of TX (US)

(73) Assignee: Nalco Chemical Company, Naperville, IL (US)

( * ) Notice: Under 35 U.S.C. 154(b), the term of this patent shall be extended for 0 days.

(21) Appl. No.: 08/340,998

(22) Filed: Nov. 17, 1994

Related U.S. Application Data

(63) Continuation-in-part of application No. 08/017,426, filed on Feb. 12, 1993, now abandoned, which is a continuation-in-part of application No. 07/566,615, filed on Aug. 13, 1990, now abandoned.

(51) Int. Cl.[7] ..... C10M 145/16
(52) U.S. Cl. ..... 508/468; 508/466
(58) Field of Search ..... 252/56 D; 508/466, 508/468

(56) References Cited

U.S. PATENT DOCUMENTS

| | | | |
|---|---|---|---|
| 3,382,056 | 5/1968 | Mehmedbasich | 44/351 |
| 3,449,250 | 6/1969 | Fields | 508/291 |
| 3,536,461 | 10/1970 | Mueller et al. | 44/396 |
| 3,560,455 | 2/1971 | Hazen et al. | 526/272 |
| 3,574,575 | 4/1971 | Gee et al. | 44/396 |
| 4,240,916 | 12/1980 | Rossi | 508/306 |
| 4,284,414 | 8/1981 | Bryant | 44/396 |
| 4,391,721 | 7/1983 | Pappas | 508/249 |
| 4,514,314 | 4/1985 | Rossi | 508/468 |
| 4,548,725 | 10/1985 | Bridger | 508/468 |
| 4,594,378 | 6/1986 | Tipton et al. | 524/106 |
| 4,839,074 * | 6/1989 | Rossi et al. | 252/56 R |

FOREIGN PATENT DOCUMENTS

| | | |
|---|---|---|
| 1800712 | 5/1969 | (DE) . |
| 1963761 | 7/1970 | (DE) . |

OTHER PUBLICATIONS

Literature Search Report No. 2638, S. Boyle, Sep. 17, 1988 "Styrene–maleic anhydride copolymer esters used as lubricant wax dispersants", 1967–Aug. 1988 (Nalco Chemical Company).

Literature Search Report No. 2639, S. Boyle, Sep. 17, 1988, "Styrene–maleic anhydride copolymer esters used as naphthenic oil pour point depressants", 1967, Aug. 1988 (Nalco Chemical Company).

* cited by examiner

*Primary Examiner*—Ellen M. McAvoy
(74) *Attorney, Agent, or Firm*—Michael B. Martin; Thomas M. Breininger

(57) ABSTRACT

This invention provides a composition and a method of using the composition for dispersing wax and improving the pour point of lubricating oils. The composition comprises an esterified styrene-maleic anhydride copolymer and an esterified alpha-olefin maleic anhydride copolymer.

3 Claims, No Drawings

COMPOSITION AND METHOD FOR LUBRICANT WAX DISPERSANT AND POUR POINT IMPROVER

This application is a continuation-in-part of Ser. No. 08/017,426 entitled "Composition and Method for Lubricant Wax Dispersant and Pour Point Improver" by Kim B. Peyton and Sophia L. Wang filed Feb. 12, 1993, now abandoned, which is in turn a continuation-in-part of Ser. No. 07/566,615 filed Aug. 13, 1990, now abandoned.

BACKGROUND OF THE INVENTION

The present invention relates to wax dispersant and pour point improver additives for hydrocarbon lubricating oils derived from petroleum.

Two problems encountered with hydrocarbon lubricating oils are visible wax particles and the need for pour point improvement. Wax particles in lubricating oil can cause blockage of filters and delivery lines on equipment and engines, thus interfering with the flow of oil to moving parts. Wax particles in lubricating oils also cause the oil to look hazy. This is especially a problem in those oils such as automotive oils, turbine oils and the like which are desirably bright and clear in appearance at room temperature. These oils typically include fractions taken from paraffinic or naphthenic crude oils or crude oil blends from the Pennsylvania, Mid-Continent, Gulf Coast and West Coast regions.

Wax haze is generally not a problem in light oils such as household lubricants and naphthenic-type lubricating oils of less than about 200 SSU viscosity at 100° F. Visible wax haze is primarily a problem in medium viscosity range oils such as naphthenic lube oils between 200 and 850 SSU viscosity at 100° F. Wax haze or particles are considered to be present in more viscous oils; but discernment is difficult because these oils are dark and opaque.

The presence of wax haze is typically detected by simple observation with the human eye and at room temperatures—i.e., about 60° to 80° F. (15° to 26° C.). Instruments which measure light transmission may be employed to help determine the clarity of an oil. However, simple visual observation is normally relied upon.

The pour point of a lubricating oil can greatly affect the type of environments in which it can be used. Additionally, lowering the pour point of lubricating oils aids in pipeline transport and pumpability. The pour point of various viscosities of lubricating oils without additives ranges from +9° C. for high viscosity oils to −18° C. for low viscosity oils. Pour point depressants can typically lower pour points as much as 30° C.

Using additives to reduce the pour point of various oils is well-known in the industry. Long chain fatty alkanol esters of copolymers of styrene and maleic anhydride and copolymers of alpha-olefins and maleic anhydride esterified with alcohols have been used as pour point depressants for fuels and lubricants. Other compounds which have been used as additives and dispersants are styrene-maleic anhydride copolymers reacted with aliphatic alcohols and tertiary amino alcohols, and ethylene vinyl acetate copolymers.

One important feature of an additive is that it be effective in small quantities. Another important feature is that the additive not produce unwanted by-products with its use in lubricating oil. An additive should also ideally perform more than one function so that fewer different additives have to be blended into the lubricating oil. Effectiveness in all viscosities and being liquid for ease of use are also desirable attributes in an additive. At the current time there is no additive available which acts both as a wax dispersant and a pour point improver much less one which meets the above criteria.

SUMMARY OF THE INVENTION

The current invention provides a composition which both lowers pour point and acts as a wax dispersant in lubricating oils, thus reducing the haziness that oils exhibit at room temperature. The composition is comprised of an esterified styrene-maleic anhydride copolymer and an esterified alpha-olefin maleic anhydride copolymer. The synergistic effect of the two copolymers together provides a more effective pour point improver than would be supplied by either copolymer alone. This means that less of the composition is necessary to gain the desired results. Additionally, both copolymers are esterified with alcohols and do not add any other elements to the lubricating oil which will result in undesired by-products. The composition is liquid at most temperatures in which it would be used, and it can be used in lubricating oils of all viscosities. The current invention also provides for a method of adding the described compositions to lubricating oil to disperse wax particles and lower the pour point of the oil.

DETAILED DESCRIPTION OF THE INVENTION

This invention provides for a novel composition which can be added to a lubricating oil to disperse wax particles and lower the pour point. The composition is a mixture or blend of an esterified styrene-maleic anhydride copolymer and an esterified alpha-olefin maleic anhydride copolymer.

The preferred esterified styrene-maleic anhydride copolymer has the structure

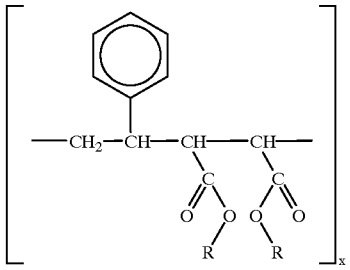

with each R being an independently selected alkyl group and X being the number of repeating units ranging from about 60 to about 400. It is preferred that the alkyl group be a straight chain alkyl group of from 16 to 30 carbon atoms. It is more preferred that the esterified styrene-maleic anhydride be the reaction product of a styrene-maleic anhydride copolymer with one or more alcohols having from 18 to 26 carbon atoms. In the most preferred composition the alcohols are a mixture of $C_{20+}$ alcohols and $C_{22}$ alcohol. The alcohols are preferably combined in about a three to one ratio with the $C_{20+}$ alcohols dominating. The esterified styrene-maleic anhydride acts as the wax dispersant and also acts as a pour point depressant. The preferred molecular weight of the styrene-maleic anhydride copolymer before esterification is 12,000 to 80,000 and the most preferred molecular weight is 24,000 to 60,000.

The preferred structure of the alpha-olefin maleic anhydride copolymer is

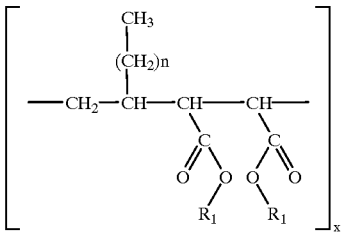

with each $R_1$ being an independently selected alkyl group, "n" is a whole number from 3–33 and X being the number of repeating units ranging from about 20 to about 220. The preferred alkyl groups are straight chain alkyl groups of 2 to 20 carbon atoms. More preferably the esterified alpha-olefin maleic anhydride is a reaction product of an alpha-olefin maleic anhydride copolymer and a mixture of alcohols having from about 4 to 18 carbon atoms. In the most preferred composition the alcohols have about 9 to 18 carbon atoms.

The preferred alpha-olefin maleic anhydride copolymer before esterification has a molecular weight over 12,000 and the preferred molecular weight is about 18,000 to about 40,000. In the preferred composition, the esterified alpha-olefin maleic anhydride before esterification is the reaction product of maleic anhydride and an alpha-olefin having about 6 to 36 carbon atoms with the most preferred alpha-olefins being linear alpha-olefins having 10 to 18 carbon atoms.

The esterified styrene-maleic anhydride copolymer and the esterified alpha-olefin maleic anhydride copolymer may be utilized in any ratio depending upon the amount of wax dispersion and pour point depression needed in the lubricating oil but should contain at least 10% of either component. The preferred ratio is from about three to one to about one to three. The most preferred ratio of esterified styrene-maleic anhydride copolymer to esterified alpha-olefin maleic anhydride copolymer is two to one.

Alpha-olefin maleic anhydride copolymers and styrene-maleic anhydride copolymers and methods of their preparation are well-known in the art. See, for example, U.S. Pat. Nos. 3,560,455 and 4,391,721 which are incorporated by reference. The styrene-maleic anhydride copolymer is generally prepared as follows. Equal molar proportions of maleic anhydride and styrene are co-polymerized. These beginning components are well-known in the art and are commercially available. The polymerization reaction is initiated by a suitable catalyst, preferably a free radical initiator and more preferably a peroxide catalyst such as benzoyl peroxide, tertiarybutyl hydroperoxide or di-t-butyl peroxide. The most preferred catalyst is t-butyl perbenzoate.

Appropriate diluents which can be used in the reaction include various heavy aromatic solvents. The duration and temperature of the reaction depend upon the desired molecular weight of the styrene-maleic anhydride copolymer. For the styrene-maleic anhydride copolymer to have a preferred molecular weight of 12,000 to 80,000, the reaction time will range from about 60 minutes to 4 hours. The preferred temperature range is about 85° C. to 110° C. To obtain the most preferred range of molecular weight which is 24,000 to 60,000 the reaction time is about 75 minutes to 120 minutes and the temperature range is about 90° C. to 100° C.

The styrene-maleic anhydride copolymer is then esterified with an appropriate alcohol. Preferably the esterification will be done with a mixture of alcohols. These alcohols may be straight chained or branched alcohols with greater than 16 carbon atoms. The preferred alcohols are straight chain alcohols with 18 to 26 carbon atoms and the most preferred alcohols are a mixture of $C_{20}$–$C_{28}$ linear alcohols typically containing in percentages by weight: 49% $C_{20}$; 29.4% $C_{22}$; 12.4% $C_{24}$; 5.0% $C_{26}$ and 2.0% $C_{28}$ alcohols and $C_{22}$ alcohol preferably in a ratio of approximately three to one. The amount of alcohol utilized in the reaction should be approximately two moles for each mole of maleic anhydride.

The esterification process is well-known to those skilled in the art. In general the alcohols are added to the styrene-maleic anhydride copolymer and reacted for a period of 3 hours to 6 hours to a temperature of about 160° C. to 170° C. Completion of the reaction can be monitored by conventional methods, such as measuring the amount of water produced by the reaction or by infrared spectroscopy. To promote the esterification reaction common catalysts can be added. Examples of common catalysts include methane sulfonic acid, acidic ion exchange resins and sulfuric acid. A preferred catalyst is dodecyl benzene sulfonic acid. The reaction will also take place in the presence of an appropriate diluent such as a heavy aromatic solvent.

The second component of the claimed composition, the esterified alpha-olefin maleic anhydride copolymer, is generally prepared as follows. The alpha-olefin and the maleic anhydride, both commercially available raw materials, are reacted in approximately a one to one molar ratio. The preferred alpha-olefin will have about 6 to about 36 carbon atoms, with the more preferred alpha-olefin having 10 to 18 carbon atoms. Again, the reaction will take place in the presence of a catalyst, preferably a free radical initiator with the most preferred free radical initiator being t-butyl perbenzoate. The olefins used can either be a single olefin or a mixture of olefins, with a mixture being preferred. The reaction will take place in a suitable diluent such as a heavy aromatic solvent.

Again the temperature and duration of the reaction depend upon the molecular weight desired for the final alpha-olefin maleic anhydride copolymer. The reaction mixture should be allowed to polymerize to a molecular weight greater than 12,000 with 18,000 to 40,000 being the preferred range. The reaction time for the preferred range is approximately 90 minutes to 210 minutes and the temperature utilized is about 100° C. to 120° C.

The resulting alpha-olefin maleic anhydride copolymer is then esterified with appropriate alcohols. The preferred alcohols are those having 4 to 18 carbon atoms with the more preferred alcohols having 9 to 18 carbon atoms. The alcohols may be added separately or in a mixture. The esterification is typically the same as that described above for the esterified styrene-maleic anhydride copolymer.

The esterified styrene-maleic anhydride copolymer and the esterified alpha-olefin maleic anhydride copolymer are then mixed or blended together. The mixture should contain at least 10% of either component. A preferred range is from three to one to one to three, with the most preferred ratio being two to one esterified styrene-maleic anhydride copolymer to esterified alpha-olefin maleic anhydride copolymer. The two esterified copolymers are mixed in the presence of heat, approximately 50° C., while stirring. The mixture should be stirred for at least 30 minutes.

The claimed composition can be added to any type of lubricating oil to disperse wax particles and to improve pour point. However, it is preferred that the composition be used with naphthenic or paraffinic lubricating oils possessing visible wax particles. The amount of the composition added to the lubricating oil will depend upon the viscosity of the lubricating oil, the amount of wax particles, and the desired pour point. Generally, the composition is added from about 25 to about 5000 ppm, preferably about 50 to about 2500 ppm. An unexpected advantage of the composition is its synergistic effect on pour point. The two compounds in mixture produce a lower pour point than either compound by itself (See Table II). Thus less of the composition is necessary to obtain the same pour point. The following examples are given to further illustrate the present invention but are not intended to limit the invention in any way.

EXAMPLE 1

The esterified styrene-maleic anhydride copolymer was prepared as follows:

Exxon 150 (300 g), a well known and widely used solvent, was added to the reactor. The agitator was started. The maleic anhydride (40 g) and styrene (40 g) were then added to the reactor. A slight sparge of nitrogen was begun in the bottom of the reactor. The reactor was heated to 90° C. During the heating process t-butyl-peroctoate (0.5 g) and Exxon 150 (5 g) were mixed. When the reactor temperature reached 90.6° C. heating was stopped and 5% of the t-Bu-Peroctoate/Exxon 150 mixture was added. The temperature began to rise and was kept below 100° C. The exotherm lasted about 10 minutes. If the exotherm does not occur, more of the catalyst solution may be added or the temperature of the reaction vessel may be slowly increased to 95° C. When the exotherm stopped and the temperature fell to at least 97° C. the t-Bu-Peroctoate/Exxon 150 mixture was added at a rate which maintained a reactor temperature of 95 to 100° C. This mixture was added over a minimum of 70 minutes.

Alfol 20+ alcohol (available from the Vista Chemical Company and identified as a mixture of $C_{20}$–$C_{28}$ linear alcohols typically containing 49% by weight $C_{20}$; 29.4% $C_{22}$; 12.4% $C_{24}$; 5.0% $C_{24}$; 5.0% $C_{26}$ and 2.0% $C_{28}$ alcohols) (240 g) and Behenyl 80 Alcohol ($C_{22}$ alcohol) (60 g) were premixed in a blend tank. The mixture was held at a temperature of 70° C. with stirring to keep the alcohols in a molten state. After all of the t-Bu-peroctoate/Exxon 150 mixture was added to the reactor it was heated to 115° C. to 121° C. and ridden for 15 minutes. The alcohol mixture and dodecyl-benzene sulfonic acid (7 g) were then added. The reactor was heated to 165° C. to 170° C. and was refluxed for six hours. The water generated was retained in the receiver. The mixture was cooled to 93° C., and Exxon 150 (300 g) was added to the reactor and mixed for 30 minutes. Tributyl amine (4 g) was added and mixed for 30 minutes to neutralize the catalyst, giving the final product

EXAMPLE 2

The esterified alpha-olefin maleic anhydride copolymer was prepared as follows:

$C_{10}$ to $C_{18}$ linear alpha olefins (280 g) were added to the reactor. Then maleic anhydride (150 g) was added to the reactor. Agitation was begun. The reactor was purged with nitrogen during this process. The reactor contents were heated to 155–160° C. and the nitrogen was stopped when 100° C. was reached. The reactor was isolated from the atmosphere. The catalyst t-butyl perbenzoate (1.3 g) was added slowly. An exotherm of 20° to 30° C. could be seen. The reaction was complete when the addition of the catalyst did not produce an exotherm.

$C_{12-16}$ alcohols (240 g), $C_{9-10}$ alcohols (100 g), n-butanol (45 g), $C_{16-18}$ alcohols (170 g) and dodecyl benzene sulfonic acid (19 g) were added in the order listed. The reactor was heated to a temperature of 120° C. and held at 120° C. for one hour. The reactor was heated to a maximum reactor temperature of 170° C. and a nitrogen purge was begun into the bottom of the reactor. It was held at 170° C. for four hours. The reactor contents were cooled to room temperature.

EXAMPLE 3

The composition was prepared as follows:

The esterified styrene-maleic anhydride (SMA) was added to the mixing vessel and heated to 120° F. (50° C.). The esterified alpha-olefin maleic anhydride copolymer (OMA) was added and stirred well. While stirring, the mixture was heated. It was stirred for 30 minutes at 50° C.

EXAMPLE 4

The esterified styrene-maleic anhydride copolymer/esterified alpha-olefin maleic anhydride copolymer composition (SMA/OMA) was added to lubricating oils of various viscosities. Table I shows the effect of the composition on wax dispersancy and pour point for different parts per million. The pour point depressant effect is compared to that of another commercially available pour point depressant (Elvax 4310).

In Table I the designations 3P-10P identify different lube oil fractions taken from a common, naphthenic, Arkansas crude. By way of example, the 7P fraction typically has an API gravity of about 21.1 to 22.4, a viscosity of about 200 to 330 SSU @ 100° F., and a viscosity index of about 46 to 48.

The lack of entries in the Wax Haze Dispersancy column for the 3P and 4P fractions indicate that these fractions were sufficiently light to not display wax crystals at room temperature.

It was observed that samples of the 9/10 P fraction at times were too dark to see whether wax crystals were present. The wax dispersancy data shown in Table I for the 9/10 P fraction were obtained on samples which were sufficiently clear to see whether such crystals were present.

TABLE I

| Lubricant Stream | Viscosity SSU @ 100° F. | Additive | Total ppm | Pour Point °F. | Wax Haze Dispersancy |
|---|---|---|---|---|---|
| 3p | 60 | None | | −5 | |
| 3p | | SMA/OMA (1:1) | 400 | −50 | |
| 3p | | SMA/OMA (2:1) | 400 | −50 | |
| 3p | | SMA/OMA (3:2) | 400 | −50 | |
| 3p | | Elvax 4310[1] | 400 | −40 | |
| 4p | 150 | None | | +25 | |
| 4p | | SMA/OMA (2:1) | 900 | −25 | |
| 4p | | SMA/OMA (2:1) | 800 | −15 | |
| 7p | 300 | None | | +45 | No |
| 7P | | SMA/OMA (1:1) | 1500 | −15 | Yes |
| 7P | | SMA/OMA (2:1) | 1500 | −15 | Yes |
| 7P | | SMA/OMA (3:2) | 1500 | −15 | Yes |
| 7P | | Elvax 4310 | 1500 | −15 | No |
| 9/10P | 1000 | None | | +90 | No |
| 9/10P | | SMA/OMA (3:1) | 2400 | +5 | Yes |
| 9/10P | | Elvax 4310 | 2400 | +25 | No |

[1]Ethylene vinylacetate copolymer produced by E. I. Du Pont de Nemours & Co.

The data in Table I reveals the superiority of the additive of the invention in the above lube oil fractions over the known depressant Elvax 4310. Only in the 7P fraction was Elvax 4310 able to match the new additive in lowering pour point. It is also interesting that Elvax 4310 was essentially ineffective as a wax dispersant, thus indicating the lack of a direct relationship between the ability of an additive to depress pour point and its ability to dispel wax haze.

Table 2 illustrates the synergistic effect of the two copolymers.

TABLE II

| | Treat Rate, ppm Total | Pour Point, °F. | Wax Dispersed |
|---|---|---|---|
| 4P Lube Stream Additive | | | |
| None | | +40 | |
| Esterified styrene-maleic anhydride | 700 | −10 | |
| Esterified alpha-olefin maleic anhydride | 700 | −25 | |
| Esterified styrene-maleic anhydride/Esterified alpha-olefin maleic anhydride (1:1) | 700 | −30 | |
| Elvax 4310 | 700 | −20 | |
| 7P Lube Stream Additive | | | |
| None | | +45 | No |
| Esterified styrene-maleic anhydride | 1500 | 0 | Yes |
| Esterified alpha-olefin maleic anhydride | 2500 | +35 | No |
| Esterified styrene-maleic anhydride/Esterified alpha-olefin maleic anhydride (1:2) | 1500 | −15 | Yes |
| Elvax 4310 | 1500 | −10 | No |

Table II compares the additive of the invention with its two component copolymers and also with Elvax 4310. The Table shows that all of the additives were successful in lowering pour point; however, the additive of the invention was superior to all of the other formulations.

The Table also shows that wax haze was a problem for the 7P fraction but not the 4P fraction. The known additive Elvax 4310, although moderately effective in lowering pour point, was ineffective in removing wax haze from the 7P fraction. The additive of the invention was not only effective in removing wax haze, but was also much more effective than either SMA or OMA in reducing pour point. It should be noted that effectiveness, if any, of OMA in reducing wax haze was not known prior to these tests. OMA proved to be ineffective as a wax dispersant for the 7P fraction, even at a very high treat rate.

Referring next to Table III below, the additive of the invention is compared with its two component copolymers in treating a light 90 neutral base oil for pour point depression. 90N Base Oil is a paraffinic lube oil having an API gravity of about 29.0 to 30.5, a viscosity of about 80 to 94 SSU at 100° F., and a Viscosity Index of about 90 to 91. Wax haze was not a problem, as evidenced by the lack of a wax dispersion in the base oil, itself.

TABLE III

| Sample Number | 90 N Base Oil Additive | Treat Rate, ppm | Pour Point, °F. | Wax Dispersed[1] |
|---|---|---|---|---|
| 1 | None | | +20 | |
| 2 | OMA[2] | 100 | +15 | |
| 3 | OMA | 200 | +15 | |
| 4 | SMA[3] | 25 | 0 | |
| 5 | SMA | 50 | −5 | |

TABLE III-continued

| Sample Number | 90 N Base Oil Additive | Treat Rate, ppm | Pour Point, °F. | Wax Dispersed[1] |
|---|---|---|---|---|
| 6 | SMA | 100 | −10 | |
| 7 | SMA/OMA[4] | 50 | −5 | |

[1]No wax visible in base oil
[2]OMA = Esterified alpha-olefin maleic anhydride
[3]SMA = Esterified styrene-maleic anhydride
[4]The ratio of SMA to OMA was 2:1.

As noted, the SMA component alone was much more effective in lowering pour point than the OMA component alone. The additive of the invention, however, was just as effective as the SMA alone, even though the concentration of SMA in the new additive (sample 7) was only two-thirds of the SMA in sample 5.

Table IV below indicates how instrumentation may be used to verify the effectiveness of determining wax haze by the human eye. In the table, the same 7P fraction listed in Tables II and III was studied here along with another lube oil fraction identified as 800 MVI. 800 MVI is a naphthenic lube oil having an API gravity of about 37.5 to 38.5, a viscosity of about 700–850 SSU at 100° F., and a Viscosity Index of about 60 to 65. Light transmittance through the samples was determined by an Emcee Electronics Model 1140 Micro-Separometer. The additive of the invention in each instance was compared with Elvax 4310.

TABLE IV

LIGHT TRANSMITTANCE IN LUBE STOCKS AFTER TREATMENT WITH SMA/OMA BLEND

| Lube Stream | Pour Point Improver | Treat Rate, Total ppm | Pour Point of | % Transmittance |
|---|---|---|---|---|
| 7P | None | | +45 | 35 |
| 7P | SMA/OMA (1:2) | 1500 | −15 | 100 |
| 7P | Elvax 4310 | 1500 | −15 | 35 |
| 800 MVI | None | | +15 | 60 |
| 800 MVI | SMA/OMA (2:1) | 1500 | +5 | 100 |
| 800 MVI | Elvax 4310 | 1500 | 0 | 60 |

As shown in Table IV, the 7P lube oil fraction had a transmittance of only 35% confirming the wax haze condition in this fraction. The haze was not dispersed by the Elvax 4310 additive, but it was dispersed by the additive of the invention. Similarly, the 800 MVI lube oil fraction had a wax haze with and without the Elvax 4310 additive. The additive of the invention, on the other hand, dispersed the haze and restored a bright, clear condition. The several measurements in this table were made with the bright clear condition reflecting 100 percent transmittance. The other readings were made relative to this calibrated value.

Table IV shows a small superiority in pour point reduction for Elvax 4310 over SMA/OMA for the 800 MVI lube stream; however, Elvax 4310 was unable to disperse the wax haze present in this stream.

Although the preferred embodiment of the composition and methods of this invention have been described above in some detail, it will be appreciated that a variety of embodiments will be readily apparent to those skilled in the art. The description of the compositions and methods of this invention is not intended to be limiting on this invention but is merely illustrative of the preferred embodiments of this invention. Other compositions and methods and variations on this method which incorporate modifications or changes to those which have been described herein are equally included within this application.

We claim:

1. A method of dispersing visible wax particles in a lubricating oil containing fractions of naphthenic or paraffinic crude oil at room temperature comprising adding to the oil from about 50 to about 2,500 parts per million of a composition comprising A) an esterified styrene-maleic anhydride copolymer wherein the number of repeating units ranges from about 60 to about 400, and wherein said copolymer is a reaction product of a styrene-maleic anhydride copolymer having a molecular weight of from about 24,000 to about 60,000 and a mixture of $C_{20}$–$C_{28}$ linear alcohols containing about 49% $C_{20}$ alcohols, about 29% $C_{22}$ alcohols about 12% $C_{24}$ alcohol, about 5% $C_{26}$ alcohols and about 2% $C_{28}$ alcohols by weight, and $C_{22}$ alcohol wherein the alcohols are in a 3 to 1 ratio for $C_{20}$–$C_{28}$ linear alcohols to $C_{22}$ alcohol; and B) an esterified alpha-olefin maleic anhydride copolymer wherein the number of repeating units ranges from about 20 to about 220, wherein the esterified alpha-olefin maleic anhydride copolymer is prepared by:

(1) reacting maleic anhydride and a mixture of linear alpha-olefins of from about 10 to about 18 carbon atoms to form an alpha olefin-maleic anhydride copolymer having a molecular weight of from about 18,000 to about 40,000 and (2) reacting the alpha olefin-maleic anhydride copolymer with a mixture of $C_9$–$C_{18}$ alcohols containing about 47% $C_{12}$–$C_{16}$ alcohols, about 20% $C_9$–$C_{10}$ alcohols and about 33% $C_{16}$–$C_{18}$ alcohols by weight, wherein the ratio of the esterified styrene-maleic anhydride copolymer to the esterified alpha-olefin maleic anhydride copolymer is from about one to two to about two to one.

2. The method of claim 1 wherein the lubricating oil is a naphthenic lubricating oil having a viscosity between about 200 and about 850 SSU at 100° F.

3. The method of claim 1 wherein the ratio of the esterified styrene-maleic anhydride copolymer to the esterified alpha-olefin maleic anhydride copolymer is about two to one.

* * * * *